US005554587A

United States Patent [19]

Capeci

[11] Patent Number: 5,554,587

[45] Date of Patent: Sep. 10, 1996

[54] PROCESS FOR MAKING HIGH DENSITY DETERGENT COMPOSITION USING CONDITIONED AIR

[75] Inventor: Scott W. Capeci, North Bend, Ohio

[73] Assignee: The Procter & Gamble Company, Cincinnati, Ohio

[21] Appl. No.: 515,406

[22] Filed: Aug. 15, 1995

[51] Int. Cl.[6] ..... C11D 11/00

[52] U.S. Cl. ..... 510/444; 510/446; 264/117; 264/140; 23/313 R

[58] Field of Search ..... 252/89.1, 174, 252/135, 174.14; 23/313 R, 313 AS; 264/117, 140

[56] References Cited

U.S. PATENT DOCUMENTS

| | | | |
|---|---|---|---|
| 3,703,772 | 11/1972 | McHugh et al. | 34/9 |
| 4,397,760 | 8/1983 | Story et al. | 252/370 |
| 4,828,721 | 5/1989 | Bollier et al. | 252/8.7 |
| 4,840,809 | 6/1989 | Hsu | 426/285 |
| 4,894,117 | 1/1990 | Bianchi et al. | 159/49 |
| 4,919,847 | 4/1995 | Barletta et al. | 252/558 |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,366,652 | 11/1994 | Capeci et al. | 252/89.1 |

FOREIGN PATENT DOCUMENTS

| | | | |
|---|---|---|---|
| 351937A1 | 1/1990 | European Pat. Off. | C11D 11/00 |
| 451894A1 | 10/1991 | European Pat. Off. | C11D 10/04 |
| 0510746A2 | 10/1992 | European Pat. Off. | C11D 11/00 |
| 1517713 | 7/1978 | United Kingdom | C11D 17/06 |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for preparing high density detergent agglomerates having a density of at least 650 g/l is provided. The process includes the steps of: (a) agglomerating an aqueous surfactant paste and dry detergent material in a mixer/densifier so as to form detergent agglomerates having a density of at least about 650 g/l; and (b) inputting air into the mixer/densifier while agglomerating the aqueous surfactant paste and the dry detergent material, wherein the air has a relative humidity below the equilibrium relative humidity of the detergent agglomerates such that at least a minor amount of water from the surfactant paste is absorbed by the air.

11 Claims, No Drawings

PROCESS FOR MAKING HIGH DENSITY DETERGENT COMPOSITION USING CONDITIONED AIR

FIELD OF THE INVENTION

The present invention generally relates to a process for producing a high density detergent composition. More particularly, the invention is directed to a process during which high density detergent agglomerates are produced using conditioned air that is inputted into the process resulting in detergent agglomerates having higher surfactant levels, improved flow properties, and a more uniform particle size distribution. The process produces free flowing, high surfactant level, detergent agglomerates having a density of at least 650 g/l which are thus particularly useful as a low dosage detergent composition or as an admix for detergent compositions.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 650 g/l or higher. The low dosage detergents are currently in high demand as they conserve resources and can be sold in small packages which are more convenient for consumers.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area of the various starting materials and their respective chemical composition. These parameters, however, can only be varied within a limited range. Thus, a substantial bulk density increase can only be achieved by additional processing steps which lead to densification of the detergent granules.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide a continuous processes for increasing the density of "post-tower" or spray dried detergent granules. Typically, such processes require a first apparatus which pulverizes or grinds the granules and a second apparatus which increases the density of the pulverized granules by agglomeration. These processes achieve the desired increase in density only by treating or densifying "post tower" or spray dried granules.

However, all of the aforementioned processes are directed primarily to densiying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of low dosage detergents. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which a starting detergent materials in the form of pastes, liquids and dry materials can be effectively agglomerated into crisp, free flowing detergent agglomerates having a high density.

Even in processes which convert starting detergent ingredients into agglomerates, there is considerable room for improvement. By way of example, it would be desirable to have such processes which produce agglomerates with even higher surfactant levels for improved cleaning. In this way, the ultimate detergent composition can deliver increased surfactant to the washing solution with similar dosages, a feature extremely beneficial for modern compact detergents. Additionally, some of these agglomeration processes have been found to be difficult to control such that agglomerates having excellent flow properties and uniform particle size can be produced. Thus, it would be desirable to have such a process which produces agglomerates that are free flowing and have a more narrow particle size distribution.

Accordingly, there remains a need in the art to have a process for continuously producing a high density detergent composition directly from starting detergent ingredients. There is also a need for a process which produces a detergent composition in the form of agglomerates which have improved flow properties, more uniform particle size and higher surfactant levels. Also, there remains a need for such a process which is more efficient and economical to facilitate large-scale production of low dosage or compact detergents.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Hollingsworth et al, European Patent Application 351,937 (Unilever); Capcci et al, U.S. Pat. No. 5,366,652 (Procter & Gamble) and Swatling et al, U.S. Pat. No. 5,205,958.

SUMMARY OF THE INVENTION

The present invention meets the aforementioned needs in the art by providing a process which produces high density, free flowing detergent agglomerates having a density of at least 650 g/l directly from a highly viscous surfactant paste and other dry detergent ingredients. The process incorporates conditioned air (e.g. dried and/or cooled air) in the process so as to enhance the ability of the process to form higher surfactant content detergent agglomerates that have the desired properties relating to flow properties and particle size. The conditioned air may be inputted into the process at one or more locations with the proviso that the air have a relative humidity below the equilibrium relative humidity of the agglomerates being produced such that at least a minor amount of water is removed from the process ingredients.

As used herein, the term "agglomerates" refers to particles formed by agglomerating detergent granules or particles which typically have a smaller median particle size than the formed agglomerates. As used herein, the phrase "at least a minor amount" of water means an amount sufficient to aid in agglomeration, typically on the order of 0.01% to about 10% by weight of the total amount of water contained in the mixture of all starting components. As used herein, the phrase "equilibrium relative humidity" means the relative humidity in an amount of air surrounding the agglomerates after it has been allowed to come to equilibrium with the agglomerates at a set temperature. The set temperature, for example, can be the processing temperature described herein. This "equilibrium relative humidity" can be measured using a hygrometer, for example a Rotronic Hydroscope Model DT1 with a WA 14 Test Cell placed in a controlled temperature environment (e.g. a controlled temperature oven). All percentages used herein are expressed as "percent-by-weight" unless indicated otherwise. All viscosities described herein are measured at 70° C. and at shear rates between about 10 to 100 $sec^{-1}$.

In accordance with one aspect of the invention, a process for preparing a high density detergent composition comprising agglomerates is provided. The process comprises the steps of: (a) agglomerating an aqueous surfactant paste and dry detergent material in a mixer/densifier so as to form detergent agglomerates having a density of at least about 650 g/l; and (b) inputting air into the mixer/densifier while agglomerating the aqueous surfactant paste and the dry detergent material, wherein the air has a relative humidity below the equilibrium relative humidity of the detergent agglomerates such that at least a minor amount of water from the surfactant paste is absorbed by the air.

In another aspect of invention, another process for preparing a high density detergent composition is provided. This process comprises the steps of: (a) agglomerating an aqueous surfactant paste and dry detergent material initially in a high speed mixer/densifier and subsequently in a moderate speed mixer/densifier so as to form detergent agglomerates having a density of at least about 650 g/l; and (b) inputting air into the mixer/densifier while agglomerating the aqueous surfactant paste and the dry detergent material, wherein the air has a relative humidity below the equilibrium relative humidity of the detergent agglomerates such that at least a minor amount of water from the surfactant paste is absorbed by the air. The equilibrium relative humidity of the agglomerates is preferably measured at processing temperature. Additionally, a product produced by the process described herein is provided.

Accordingly, it is an object of the present invention to provide a process for producing high density, free flowing detergent composition having a density of at least 650 g/l. It is also an object of the invention to provide a process which produces a high density detergent composition having improved flow properties and higher surfactant levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENTS

Process

The present invention is directed to a process which produces free flowing, high density detergent composition which is at least partially in the form of agglomerates having a density of at least about 650 g/l. Generally, the present process is used in the production of low dosage detergents, whereby the resulting detergent agglomerates can be used as a detergent composition itself or as a detergent additive for a more fully formulated detergent composition. For example, the process can be used to form "high active" (i.e. high surfactant level) detergent agglomerates which are used as an admix for purposes of enhancing the active levels in granular low dosage detergents and thereby allow for more compact detergents.

The process produces high density detergent agglomerates from a highly viscous surfactant paste having a relatively high water content, typically at least about 5%, to which dry detergent material is added. Preferably, the process includes inputting air while agglomerating the aqueous surfactant paste and the dry detergent material. The air is preferably conditioned such that it has a relative humidity below the equilibrium relative humidity of the detergent agglomerates at the processing temperature during the agglomeration step. Preferably, the air is cooler than this processing temperature such that the detergent agglomerates are cooled even further. In this way, at least a minor amount of water from the surfactant paste is absorbed by the air. It is the excess water in the surfactant paste which is believed to hinder agglomeration and removal of it serves to enhance agglomeration and the formation of highly dense, free flowing agglomerates with a uniform particle size.

While not intending to be bound by theory, it is also believed that the removal of water from the process (especially the surfactant paste) raises the "sticky point" temperature of the agglomerates formed. This so-called "sticky point" temperature is the temperature at which the agglomerates tend to coagulate or "stick" together resulting in the formation of large particles or "clumps" which are not desirable and which lead to rapid particle size growth and variation. By having a higher "sticky point" temperature as a result of a reduction in water in the process ingredients, agglomeration can occur in a controlled fashion in that agglomeration occurs at higher temperatures which results in higher active, free flowing, dense agglomerates being produced. Additionally, removal of water also reduces the agglomerate temperature, thereby raising the required amount of energy per unit mass for the process resulting in a more controllable process.

Preferably, the starting detergent materials are agglomerated and densified to produce particles having a density of at least about 650 g/l and, more preferably from about 700 g/l to about 800 g/l. To achieve the desired density of at least about 650 g/l, the agglomeration step can be carried forth in a mixer/densifier suitable for mixing and densifying liquids, solids and mixtures thereof. More preferably, the agglomeration step occurs initially in a high speed mixer/densifier followed by a moderate speed mixer/densifier. The high speed mixer/densifier is a Lödige CB 30 mixer or similar brand mixer. These types of mixers essentially consist of a horizontal, hollow static cylinder having a centrally mounted rotating shaft around which several plough-shaped blades are attached. Preferably, the shaft rotates at a speed of from about 100 rpm to about 2500 rpm, more preferably from about 300 rpm to about 1600 rpm. Preferably, the mean residence time of the detergent ingredients in the high speed mixer/densifier is preferably in range from about 2 seconds to about 45 seconds, and most preferably from about 5 seconds to about 15 seconds.

Preferably, the resulting detergent agglomerates formed in the high speed mixer/densifier are then fed into a lower or moderate speed mixer/densifier during which further agglomeration and densification is carried forth. This particular moderate speed mixer/densifier used in the present process should include liquid distribution and agglomeration tools so that both techniques can occur simultaneously. It is preferable to have the moderate speed mixer/densifier be, for example, a Lödige KM 600 (Ploughshare) mixer, Drais® K-T 160 mixer or similar brand mixer. The residence time in the moderate speed mixer/densifier is preferably from about 0.5 minutes to about 15 minutes, most preferably the residence time is about 1 to about 10 minutes. The liquid distribution can be accomplished by cutters, generally smaller in size than the rotating shaft, which preferably operate at about 3600 rpm.

The air inputted in the process can occur in a variety of locations in the process. By way of example, the air can be inputted in any inlet port of the mixer/densifier, and if more than one mixer/densifier is used, in any one or combination of inlet ports of the mixer/densifiers used in the process. The most preferred location for the air is an inlet port near the entrance of the mixer/densifier, and specifically, the inlet port of the high speed mixer/densifier in the high speed followed by moderate speed mixer/densifier set up as described previously. In a preferred embodiment, the flow rate of the air is from about 1 kg/hr to about 100,000 kg/hr, more preferably from about 10 to about 50,000 kg/hr, and most preferably from about 300 to about 10,000 kg/hr. Preferably, the temperature of the air is below that of the agglomerates being produced in the process. Typically, this temperature will be in a range of from about 0° C. to about 60° C., more typically from about 5° C. to about 50° C., and most typically from about 5° C. to about 20° C. Similarly, the air will have a relative humidity below that of the agglomerates at the processing temperature and will typically be in a range of from about 5% to about 95%, more typically from about 7% to about 60%, and most typically from about 10% to about 25%. The temperature, flow rate and humidity of the air can be regulated using one or more of known apparatus, such as fans, and cooling coil and valve assemblies. In this way, absorption of at least a minor amount of water from the surfactant paste in the process will be insured and it has been surprisingly found that this results in superior agglomerates being formed.

The present process entails mixing from about 1% to about 70%, more preferably from about 5% to about 50% and, most preferably from about 5% to about 20%, by weight of dry detergent material into the mixer/densifier which also absorbs at least a minor amount of the water from the surfactant paste in addition to the air described herein. The highly viscous surfactant paste and dry detergent ingredients fed to the mixer/densifier(s) are described more fully hereinafter.

The detergent agglomerates produced by the process preferably have a surfactant level of from about 25% to about 55%, more preferably from about 35% to about 55% and, most preferably from about 45% to about 55%. The particle porosity of the resulting detergent agglomerates produced according to the process of the invention is preferably in a range from about 5% to about 20%, more preferably at about 10%. In addition, an attribute or dense or densified agglomerates is the relative particle size. The present process typically provides detergent agglomerates having a median particle size of from about 400 microns to about 700 microns, and more preferably from about 400 microns to about 600 microns. As used herein, the phrase "median particle size" refers to individual agglomerates and not individual particles or detergent granules. The combination of the above-referenced porosity and particle size results in agglomerates having density values of 650 g/l and higher. Such a feature is especially useful in the production of low dosage laundry detergents as well as other granular compositions such as dishwashing compositions.

Optional Process Steps

In an optional step of the present process, the detergent agglomerates formed by the process or dried in a fluid bed dryer and/or further conditioned by cooling the agglomerates in a fluid bed cooler or similar apparatus as are well known in the art. Another optional process step involves adding a coating agent to improve flowability and/or minimize over agglomeration of the detergent composition in one or more of the following locations of the instant process: (1) the coating agent can be added directly after the fluid bed cooler or dryer; (2) the coating agent may be added between the fluid bed dryer and the fluid bed cooler; (3) the coating agent may be added between the fluid bed dryer and the mixer/densifier(s); and/or (4) the coating agent may be added directly to one or more of the mixer/densifiers. The coating agent is preferably selected from the group consisting of aluminosilicates, silicates, carbonates and mixtures thereof. The coating agent not only enhances the free flowability of the resulting detergent composition which is desirable by consumers in that it permits easy scooping of detergent during use, but also serves to control agglomeration by preventing or minimizing over agglomeration, especially when added directly to the mixer/densifier(s). As those skilled in the art are well aware, over agglomeration can lead to very undesirable flow properties and aesthetics of the final detergent product.

Another very viable coating agent include builder materials which have the formula $(M_x)_i\ Ca_y(CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}(x_i$ multiplied by the valence of $M_i)+2y=2z$ is satisfied such that the formula has a neutral or "balanced" charge. Waters of hydration or anions other than carbonate may be added provided that the overall charge is balanced or neutral. The charge or valence effects of such anions should be added to the right side of the above equation. Preferably, there is present a water-soluble cation selected from the group consisting of hydrogen, water-soluble metals, hydrogen, boron, ammonium, silicon, and mixtures thereof, more preferably, sodium, potassium, hydrogen, lithium, ammonium and mixtures thereof, sodium and potassium being highly preferred. Nonlimiting examples of noncarbonate anions include those selected from the group consisting of chloride, sulfate, fluoride, oxygen, hydroxide, silicon dioxide, chromate, nitrate, borate and mixtures thereof. Preferred builders of this type in their simplest forms are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof. An especially preferred material for the builder described herein is $Na_2Ca(CO_3)_2$ in any of its crystalline modifications. Suitable builders of the above-defined type are further illustrated by, and include, the natural or synthetic forms of any one or combinations of the following minerals: Afghanite, Andersonite, AshcroftineY, Beyerite, Borcarite, Burbankite, Butschliite, Cancrinite, Carbocernaite, Carletonite, Davyne, DonnayiteY, Fairchildite, Ferrisurite, Franzinite, Gaudefroyite, Gaylussite, Girvasite, Gregoryitc, Jouravskite, KamphaugiteY, Kettnerite, Khanneshite, LepersonniteGd, Liottite, MckelveyiteY, Microsommite, Mroseite, Natrofairchildite, Nyerereite, RemonditeCe, Sacrofanite, Schrockingerite, Shortite, Surite, Tunisite, Tuscanite, Tyrolite, Vishnevite, and Zemkorite. Preferred mineral forms include Nyererite, Fairchildite and Shortite.

Optionally, the process can comprises the step of spraying an additional binder in the mixer/densifier(s). A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Aqueous Surfactant Paste

The detergent surfactant paste used in the process is preferably in the form of an aqueous viscous paste, although forms are also contemplated by the invention. This so-called viscous aqueous surfactant paste has a viscosity of from about 5,000 cps to about 100,000 cps, more preferably from about 10,000 cps to about 80,000 cps, and contains at least about 5% water, more preferably at least about 20% water. The viscosity is measured at 70° C. and at shear rates of about 10 to 100 $sec.^{-1}$, preferably 25 to 50 $sec^{-1}$. The surfactant paste is a non-Newtonian, nonlinear viscoelastic fluid for which the viscosity can be only measured on a device with an adjustable shear rate, for example, a "controlled stress rheometer" with a cone and plate geometry that is commercially available from TA Instruments, Inc., under the trade name Carri-Med CSL 100. A conventional Brookfield viscometer would not suffice for accurately measuring the viscosity of the present surfactant paste. Furthermore, the surfactant paste preferably comprises from about 70 to 95% by weight of a detersive surfactant and the balance water and adjunct detergent ingredients.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockreli, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste include the conventional $C_{11}$–$C_{18}$alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH^2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include and $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206, 154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the present process preferably comprises materials selected front the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials. More preferably, the dry detergent material is selected from the group consisting of aluminosilicates, carbonates, sulfates, carbonate/sulfate complexes, and mixtures thereof. Most preferably, the dry detergent material comprise a detergent aluminosilicate builder which are referenced as aluminosilicate ion exchange materials and sodium carbonate.

The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Additionally, those builder materials discussed previously as an optional coating agent can be used herein. These particular builder materials have the formula $(M_x)_i\ Ca_y(CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}(x_i$ multiplied by the valence of $M_i)+2y=2z$ is satisfied such that the formula has a neutral or "balanced" charge. Additional details and examples of these builder materials have been set forth previously and are incorporated herein by reference. Preferably, these builder materials are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehi, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carbonxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates the process of the invention which produces free flowing, crisp, high density detergent composition. Two feed streams of various detergent starting ingredients are continuously fed, at a rate of 1200 kg/hr, into a Lödige CB 30 mixer/densifier, one of which comprises a surfactant paste containing surfactant and water and the other stream containing starting dry detergent material containing aluminosilicate and sodium carbonate. The rotational speed of the shaft in the Lödige CB 30 mixer/densifier is about 1400 rpm and the mean residence time is about 10 seconds. Air is also pumped into the mixer/densifier at a rate of 260 kg/hr and which has a equilibrium relative humidity of 50% and a temperature of 32° C. The agglomerates being formed in the Lödige CB 30 mixer/densifier have a temperature of 49° C. and a equilibrium relative humidity of 100%. The contents from the Lödige CB 30 mixer/densifier are continuously fed into a Lödige KM 600 mixer/densifier for further agglomeration during which the mean residence time is about 4 minutes. The resulting detergent agglomerates are then fed to a fluid bed dryer and then to a fluid bed cooler, the mean residence time being about 10 minutes and 5 minutes, respectively. The detergent agglomerates are then screened with conventional screening apparatus resulting in a uniform particle size distribution. The composition of the detergent agglomerates exiting the fluid bed cooler is set forth in Table I below:

TABLE I

| Component | % Weight of Total Feed |
|---|---|
| $C_{14-15}$ alkyl sulfate/$C_{12.3}$ linear alkylbenzene sulfonate | 30.0 |
| Aluminosilicate | 37.4 |
| Sodium carbonate | 20.4 |
| Polyethylene glycol (MW 4000) | 1.4 |
| Misc. (water, etc.) | 10.8 |
| | 100.0 |

The median particle size is 591 microns. Additional detergent ingredients including perfumes, enzymes, and other minors are sprayed onto the agglomerates described above in the finishing step to result in a finished detergent composition. The relative proportions of the overall finished detergent composition produced by the process of instant process is presented in Table II below:

TABLE II

| Component | (% weight) A |
|---|---|
| $C_{14-15}$ alkyl sulfate/$C_{12.3}$ linear alkylbenzene sulfonate | 16.3 |
| Neodol 23-6.5[1] | 3.0 |
| $C_{12-14}$ N-methyl glucamide | 0.9 |
| Polyacrylate (MW = 4500) | 3.0 |
| Polyethylene glycol (MW = 4000) | 1.2 |
| Sodium Sulfate | 8.9 |
| Aluminosilicate | 26.3 |
| Sodium carbonate | 27.2 |
| Protease enzyme | 0.4 |
| Amylase enzyme | 0.1 |
| Lipase enzyme | 0.2 |
| Cellulose enzyme | 0.1 |
| Minors (water, perfume, etc.) | 12.4 |
| | 100.0 |

[1] $C_{12-13}$ alkyl ethoxylate (EO = 6.5) commercially available from Shell Oil Company.

The density of the resulting detergent composition is 796 g/l, the median particle size is 600 microns. The detergent composition has surprisingly improved flow properties and a more narrow particle size distribution.

Having tires described the invention in detail, it will be obvious to those skilled in the art that various changes may be made without departing from the scope of the invention and the invention is not to be considered limited to what is described in the specification.

What is claimed is:

1. A process for preparing a high density detergent composition comprising the steps of:

(a) agglomerating an aqueous surfactant paste and dry detergent material initially in a high speed mixer/densifier and subsequently in a moderate speed mixer/densifier so as to form detergent agglomerates having a density of at least about 650 g/l, wherein said aqueous surfactant paste has a viscosity of from about 5,000 cps to about 100,000 cps and contains from about 70% to 95%, by weight of said aqueous surfactant paste, of a detersive surfactant and the balance water and adjunct ingredients and said dry detergent material is selected from the group consisting of carbonates, sulfates, carbonate/sulfate complexes, tripolyphosphates, tetrasodium pyrophosphate, citrates, aluminosilicates, cellulose-based materials and organic synthetic polymeric absorbent gelling materials; and (b) inputting air into said high speed mixer/densifier and said moderate speed mixer/densifier while agglomerating said aqueous surfactant paste and said dry detergent material, wherein said air has a relative humidity below the equilibrium relative humidity of said detergent agglomerates such that at least a minor amount of water from said surfactant paste is absorbed by said air.

2. The process of claim 1 wherein the flow rate of said air is from about 1 kg/hr to about 100,000 kg/hr.

3. The process of claim 1 wherein the temperature of said air is in a range of from about 0° C. to about 60° C.

4. The process of claim 1 wherein the equilibrium humidity of said air is in a range of from about 5% to about 95%.

5. The process of claim 1 further comprising the step of drying said detergent agglomerates.

6. The process of claim 1 further comprising the step of adding an additional binder to said high speed mixer/densifier during said agglomerating step.

7. The process of claim 8 wherein said additional binder is selected from the group consisting of water, anionic surfactants, nonionic surfactants, polyethylene glycol, polyacrylates, citric acid and mixtures thereof.

8. The process of claim 1 wherein said dry detergent material is selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof.

9. The process of claim 1 wherein said agglomerates have a median particle size of from about 400 microns to about 600 microns.

10. The process of claim 1 wherein the mean residence time of said detergent agglomerates in said high speed mixer/densifier is in range from about 2 seconds to about 45 seconds.

11. The process of claim 1 wherein the mean residence time of said detergent agglomerates in said moderate speed mixer/densifier is in range from about 0.5 minutes to about 15 minutes.

* * * * *

UNITED STATES PATENT AND TRADEMARK OFFICE

CERTIFICATE OF CORRECTION

PATENT NO. : 5,554,587

DATED : September 10, 1996

INVENTOR(S) : Capeci, Scott W.

It is certified that error appears in the above-indentified patent and that said Letters Patent is hereby corrected as shown below:

Column 2, line 2, change "densiying" to -- densifying --.

Column 2, line 57, change "Capcci" to -- Capeci --.

Column 6, line 66-67, change "Burbamkite" to -- Burbankite --.

Column 7, line 2, change "Gregoryitc" to -- Gregoryite --.

Column 7, line 59, change "Cockreli" to -- Cockrell --.

Column 8, line 36, change "front" to -- from --.

Column 10, line 65, change "Diehi" to -- Diehl --.

Column 11, line 20, change "carbonxylate" to -- carboxylate --.

Column 12, line 54, change "tires" to -- thus --.

Signed and Sealed this

Fifteenth Day of July, 1997

*Attest:*

*Attesting Officer*

BRUCE LEHMAN

*Commissioner of Patents and Trademarks*